US008870034B2

(12) United States Patent
Suzuki et al.

(10) Patent No.: US 8,870,034 B2
(45) Date of Patent: Oct. 28, 2014

(54) MATERIAL PRESSURE FEEDING APPARATUS

(75) Inventors: Atsushi Suzuki, Tokyo (JP); Toshiyuki Takahashi, Tokyo (JP)

(73) Assignee: Three Bond Co. Ltd., Tokyo (JP)

( * ) Notice: Subject to any disclaimer, the term of this patent is extended or adjusted under 35 U.S.C. 154(b) by 24 days.

(21) Appl. No.: 13/696,612

(22) PCT Filed: Apr. 18, 2011

(86) PCT No.: PCT/JP2011/059481
§ 371 (c)(1),
(2), (4) Date: Nov. 7, 2012

(87) PCT Pub. No.: WO2011/148735
PCT Pub. Date: Dec. 1, 2011

(65) Prior Publication Data

US 2013/0056491 A1 Mar. 7, 2013

(30) Foreign Application Priority Data

May 24, 2010 (JP) ..... 2010-118292

(51) Int. Cl.

| | |
|---|---|
| ***B67D 7/60*** | (2010.01) |
| ***B05C 11/10*** | (2006.01) |
| ***B05B 9/047*** | (2006.01) |
| *B05C 17/00* | (2006.01) |
| *B05C 17/005* | (2006.01) |

(52) U.S. Cl.

CPC ..... *B05B 9/047* (2013.01); *B05C 17/002* (2013.01); *B05C 17/00583* (2013.01); *B05C 11/10* (2013.01); *B05C 17/00576* (2013.01)

USPC ..... 222/386; 222/105; 222/405; 222/95

(58) Field of Classification Search

CPC .. B65D 83/0072; B67D 1/045; B67D 1/0462; B67D 7/0255; B67D 7/0244; B67D 7/60; F04B 15/02; F04B 39/00; F04B 45/041; G01F 1/00; G01F 11/00

USPC ..... 222/95, 405, 386, 386.5, 252, 256, 96, 222/97, 183, 105

See application file for complete search history.

(56) References Cited

U.S. PATENT DOCUMENTS

| | | | | |
|---|---|---|---|---|
| 5,730,250 | A * | 3/1998 | Tsai | 184/31 |
| 2006/0276762 | A1* | 12/2006 | Nakazawa et al. | 604/319 |
| 2008/0054024 | A1* | 3/2008 | Kubota | 222/386.5 |

FOREIGN PATENT DOCUMENTS

| | | | |
|---|---|---|---|
| GB | 2 126 665 | A | 3/1994 |
| JP | 31-000804 | B1 | 2/1956 |
| JP | 49-090473 | U | 8/1974 |

(Continued)

OTHER PUBLICATIONS

International Search Report of PCT/JP2011/05948, mailing date Jul. 12, 2011.

*Primary Examiner* — Frederick C Nicolas
*Assistant Examiner* — Bob Zadeh
(74) *Attorney, Agent, or Firm* — Westerman, Hattori, Daniels & Adrian, LLP

(57) ABSTRACT

A material pressure feeding apparatus 10 includes a container 12 for receiving a bag 11, in which a viscous material M is contained, a press member 13 exerting a pressing force on the material, a pressure feeder 15 pressure-feeding, to the outside, the material M sucked by the pressing force by the press member 13, and an annular member 16 positioned on the outer peripheral side of the press member 13. The press member 13 has a supporting space S on the outer peripheral side thereof, and a ring portion 40 constituting an annular member 16 is supported in the supporting space S in a relatively movable state. Thus, even when the press member 13 is inclined, the annular member 16 is configured so as not to form a clearance between it and the inner peripheral surface of the container 12 without any influence of the inclination.

6 Claims, 6 Drawing Sheets

(56) References Cited

FOREIGN PATENT DOCUMENTS

| | | | |
|---|---|---|---|
| JP | 50-013907 | A | 2/1975 |
| JP | 58-163500 | A | 10/1983 |
| JP | 59-136585 | A | 8/1984 |
| JP | 03-246379 | A | 11/1991 |
| JP | 11-036571 | A | 2/1999 |
| JP | 2002-195153 | A | 7/2002 |
| JP | 2006-102655 | A | 4/2006 |

* cited by examiner

MATERIAL PRESSURE FEEDING APPARATUS

TECHNICAL FIELD

The present invention relates to a material pressure feeding apparatus, and more particularly to a material pressure feeding apparatus that can pressure-feed a material by pressing the material with a press member communicable with the inside of a bag in a state that the bag containing a viscous material is placed in a container, and in this case, does not catch the bag in between an outer peripheral side of the press member and the inner periphery of the container.

BACKGROUND ART

Resin materials of high viscosity such as reactive silicones and epoxy resins have been utilized as sealing materials. Such resin materials contained in a predetermined container are configured to be sucked and fed with pressure by required amount, using a material pressure feeding apparatus, to a nozzle, from which the materials are discharged onto a sealing surface of a flange and the like of a workpiece.

An arrangement as described in Patent document 1, for example, is known as the above material pressure feeding apparatus. In this arrangement, a lid (a press member) having a through-hole for materials is arranged on an upper portion of a container containing a viscous material, and this can feed the material with pressure by lowering the press member.

Another arrangement as described in Patent document 2 is also known. In this arrangement, a bag containing a viscous material is placed into a container, and this can suck and pressure-feed the material in the bag by lowering a press member arranged on an upper portion of the bag.

Patent document 1: Japanese Utility Model Application Laid-open No. 58-163500

Patent document 2: Japanese Patent Application Laid-open No. 2006-102655

SUMMARY OF THE INVENTION

Problems to be Solved by the Invention

In the material pressure feeding apparatuses disclosed in Patent documents 1 and 2, each press member is lowered in a container using a driving unit, such as a cylinder, to exert a pressing force on a material. However, the inclination of a pressing surface of the press member with respect to the horizon (for example, about 1°) is usually occurred when the press member is lowered. Such inclination can be eliminated by providing a plurality of guide rods to keep straightly downward property of the press member. However, adoption of such an arrangement not only leads to a complicated apparatus configuration and an increased size, but also an increased burden of cost, which is poor economy.

Therefore, in the case of the apparatus disclosed in Patent document 1, such a disadvantage is occurred that the material leaks from a clearance that can occur between the outer periphery of the press member and the inner periphery of the container due to the inclination of the press member. Moreover, in the arrangement disclosed in Patent document 2, such a disadvantage arises that the bag containing the material is caught in between the outer peripheral side of the press member and the inner periphery of the container, resulting in a waste of the material accordingly.

Object of the Invention

The present invention has been proposed in view of the above disadvantage. An object of the present invention is to provide a material pressure feeding apparatus that sucks and feeds materials within a bag by placing the bag containing a viscous material in a container and exerting a pressing force on the material, wherein the apparatus does not catch the bag in between the outer peripheral side of a press member and the inner periphery of the container, and can prevent a waste of the material, even when the press member is inclined.

Means to Solve the Problems

In order to achieve the above object, the present invention adopts an arrangement described in claims. Specifically, the present invention adopts a material pressure feeding apparatus including a container having a top opening for receiving a bag, in which a viscous material is contained, a press member having a through-hole communicable with an aperture formed in an upper portion of the bag positioned within the container, the press member being positioned on the bag, and a pressure feeder including a pressure feed passage that is in communication with the through-hole, and feeding with pressure the material within the bag by lowering the press member, comprising:

an annular member positioned on the outer peripheral side of the press member to be capable to pressing an inner periphery of the container outward along a radial direction, wherein the annular member is supported by the press member while permitted to be relatively moved with respect to the press member.

In the present invention, such an arrangement is preferably adopted that the press member comprises an upper pressing plate, and a lower pressing plate attached to the lower surface side of the upper pressing plate in a state of a supporting space is formed between a lower surface of the outer peripheral side of the upper pressing plate and the lower pressing plate, the annular member includes a plate-shaped ring portion, and an outer peripheral portion provided continuously downward from an outer periphery of the ring portion, the outer peripheral portion being capable of pressing the inner periphery of the container, and the ring portion is movably provided within the supporting space.

Also, the material pressure feeding apparatus may further comprise a bag suction preventing member arranged in the through-hole of the press member, wherein the bag suction preventing member includes spacers arranged at predetermined intervals in a circumferential direction, and a circular member attached to the spacers.

Further, such an arrangement may be adopted that the circular member comprises a plurality of openings at predetermined intervals in the circumferential direction, each of the openings being substantially fan-shaped in planar view.

Furthermore, such an arrangement may be adopted that the circular member comprises a plurality of circular holes, the holes in a central region are arranged more densely than holes on the outer peripheral side thereof.

Effects of the Invention

According to the present invention, since the annular member is supported relatively movably with respect to the press member, the annular member can be kept horizontal even when a pressing surface of the press member is inclined relative to the horizon. Thus, the outer periphery of the annular member is maintained at a state in which it evenly presses the inner peripheral surface of the container to be capable of preventing the bag to be caught in a clearance formed between it and the inner peripheral surface of the container. This eliminates a waste of the material associated with that fact the bag is caught in.

Moreover, the press member includes the upper pressing plate, and the lower pressing plate attached to the lower surface side of the upper pressing plate in the state of the supporting space is formed between the lower surface of the outer peripheral side of the upper pressing plate and the lower pressing plate. Therefore, the annular member can be attached and detached, and even when the annular member is required to be replaced, it is possible to cope it without difficulty.

Further, an arrangement including the bag suction preventing member can prevent the bag from being sucked into the through-hole of the press member even when the material is pressure-fed with the material contained in the bag.

BRIEF DESCRIPTION OF DRAWINGS

FIG. 3(A) is schematic plan view of a lower pressing plate.

DESCRIPTION OF THE PREFERRED EMBODIMENTS

Hereinafter, an embodiment of the present invention will be described with reference to the drawings. In this specification, the wordings "upper" and "lower" are used with reference to FIG. 2, unless otherwise specified.

Figure 1:
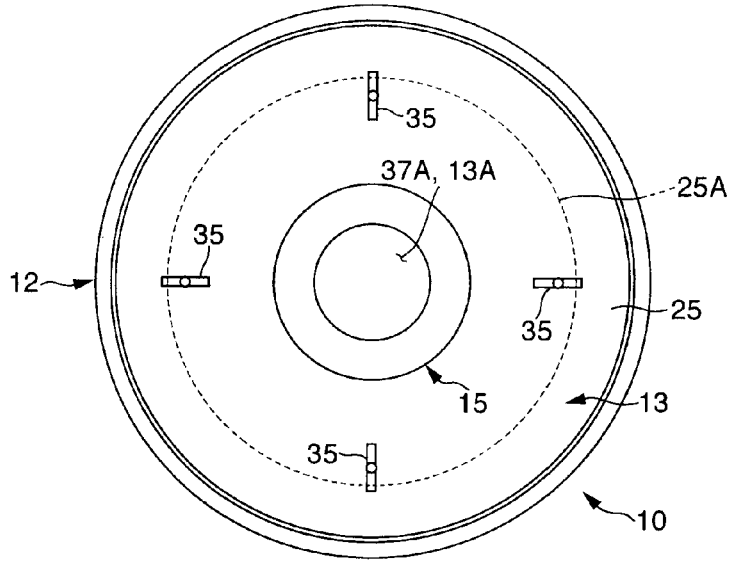
FIG. 1 is a schematic plan view of a material pressure feeding apparatus according to an embodiment.
Figure 2:
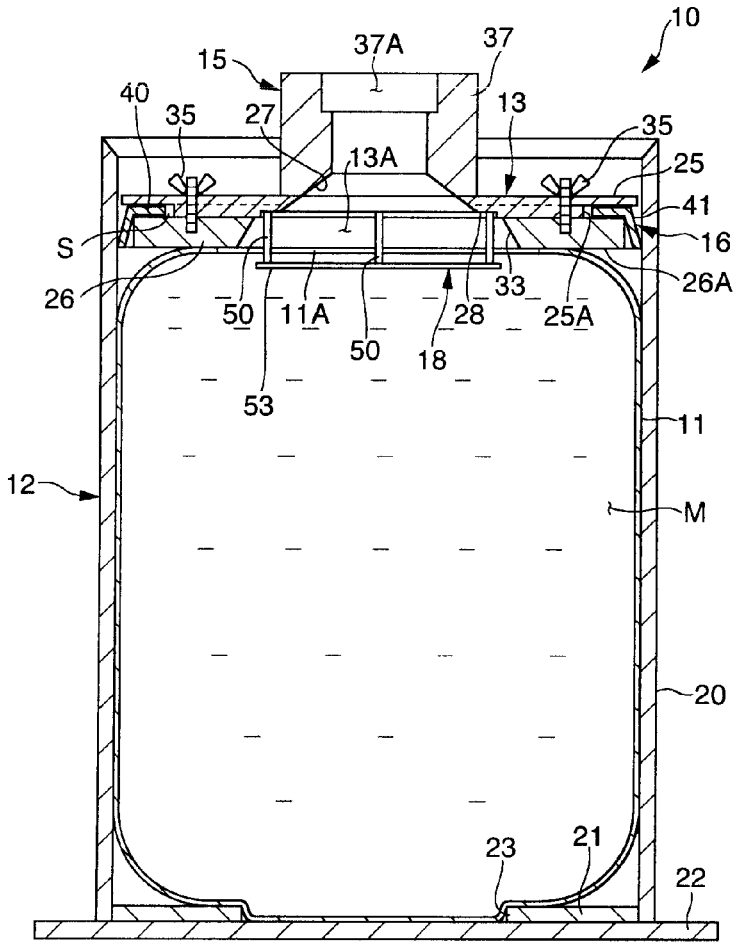
FIG. 2 is a vertical cross-sectional view of the material pressure feeding apparatus.

Referring to FIGS. 1 and 2, a material pressure feeding apparatus 10 comprises a bag 11, in which a material M of a high viscosity resin such as a silicone is contained; a container 12 having a top opening for receiving the bag 11; a press member 13 having a through-hole 13A communicable with an aperture 11A formed in an upper portion of the bag 11, the press member 13 positioned on the bag 11; a pressure feeder 15 positioned on the upper portion side of the press member 13, and sucking and feeding the material M within the bag 11 by lowering the press member 13; an annular member 16 supported on the outer peripheral side of the press member 13, thereby an inner periphery of the container 12 being pressed outward along a radial direction; and a bag suction preventing member 18 positioned within the through-hole 13A of the press member 13.

The bag 11 is formed of a resin film, sealed on the opening side while the material M is contained therein, and is contained in an inverted position such that the sealed portion is positioned on the bottom side of the container 12. Such a contained suck 11 is cut off in an upper central region thereof using any appropriate cutter blade to form the aperture 11A, and then the press member 13 is placed on the bag 11 in a state that a lower end side of the suction preventing member 18 is arranged in the aperture 11A.

The container 12 is formed of polyvinyl chloride as a molding material in the embodiment, but is not particularly limited thereto. The container 12 includes a peripheral wall portion 20 having a substantially cylindrical shape and oriented in a vertical direction, a bottom wall portion 21 positioned in a lower portion of the peripheral wall portion 20, and a base 22 positioned on the lower surface side of the bottom wall portion 21. A circular recess 23 is formed in a central region of the bottom wall portion 21 such that it receives a lower portion of the suction preventing member 18 to prevent the material M from wastefully remaining in the bag 11 when the press member 13 reaches the limit of descent at which it is substantially brought into contact with the bottom wall portion 21.

Figure 3A:
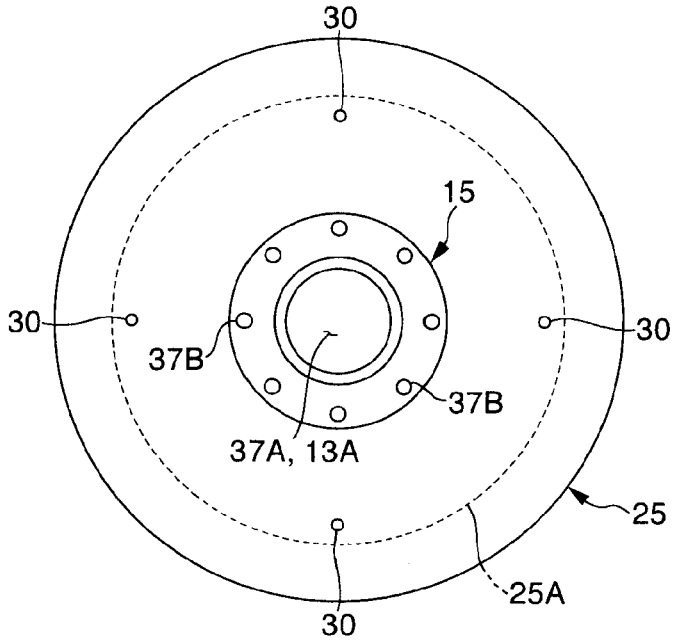
FIG. 3(A) is a schematic plan view of a state that an upper pressing plate is fixed to a pressure feeder.
Figure 3B:
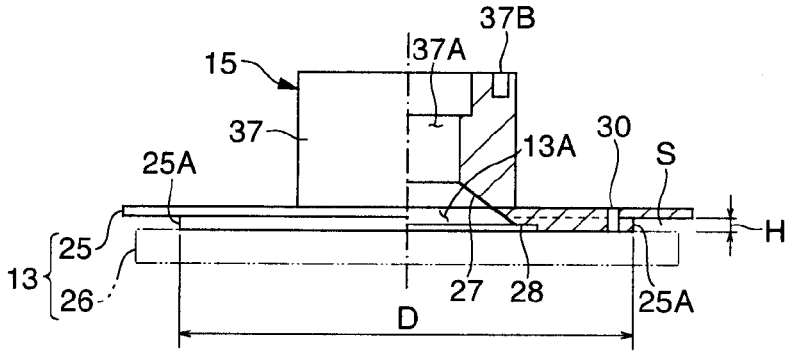
FIG. 3(B) is a cross-sectional view thereof.
Figure 3C:
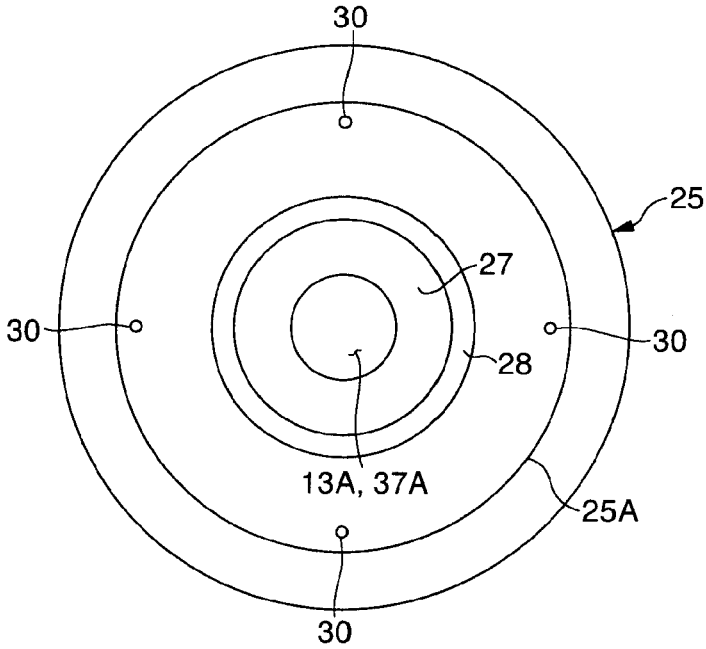
FIG. 3(C) is a bottom view thereof.
Figure 4A:
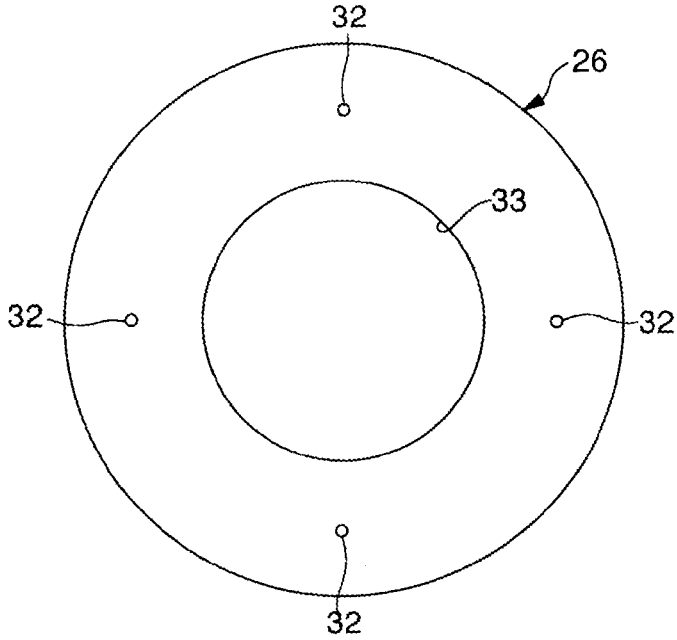
FIG. 4(B) is a partially cross-sectional view thereof.
FIG. 4(C) is a bottom view thereof.
Figure 4B:
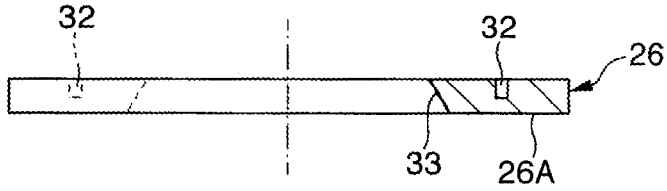
Figure 4C:
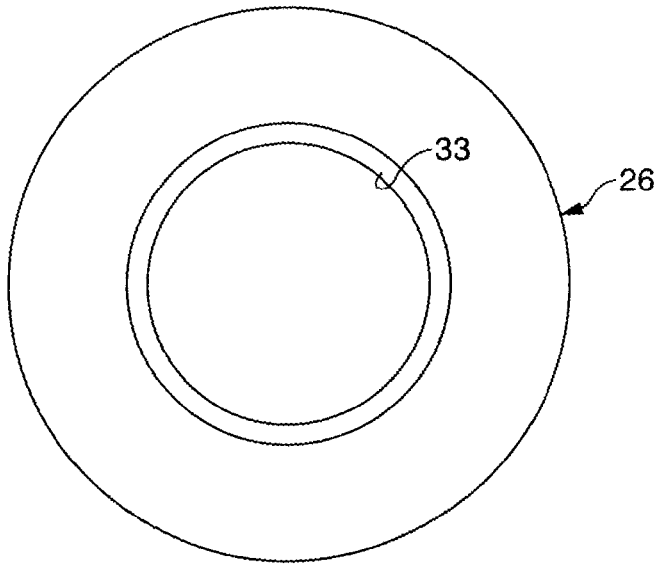

The press member 13, as also shown in FIGS. 3 and 4, includes a ring-shaped upper pressing plate 25 integrated with the pressure feeder 15 via means such as welding such that the pressure feeder 15 is positioned on the upper surface side thereof; a ring-shaped lower pressing plate 26 attached to the lower surface side of the upper pressing plate 25 in a state that a supporting space S is formed between a lower surface on the outer peripheral side of the upper pressing plate 25 and the lower pressing plate 26 (see FIG. 3(B)). The upper pressing plate 25 includes a step portion 25A on the outer peripheral side of the lower surface, and has a plate thickness on the outer peripheral side thereof designed to be relatively smaller than that of the step portion 25A. The height of the supporting space S is defined by the height of the step portion 25A. In connection to this, the height H of the step portion 25A in the embodiment is designed to be 6 mm, and the inner diameter D surrounded by the step portion 25A is designed to 196 mm. Further, a central region of the upper pressing plate 25 has a taper hole 27, the opening diameter of which decreases upward. A ring-shaped planar portion 28 is formed from a lower end of the taper hole 27 outward. Furthermore, in the upper pressing plate 25, through-apertures 30 are spaced at intervals of 90 degrees in a circumferential direction within a plane inside the step portion 25A.

The lower pressing plate 26, as shown in FIG. 4, includes screw holes 32 on the upper surface side thereof at positions spaced at intervals of 90 degrees in a circumferential direction, the screw holes 32 positioned on the same axis as the through-aperture 30, and a taper hole 33 in a central region thereof which has the opening diameter larger than that of the taper hole 27. The taper holes 27 and 33 constitute the through-hole 13A. The upper and lower pressing plates 25 and 26 are arranged so as to sandwich a portion of the annular member 16 by utilizing the supporting space S, and connected to each other using screws 35 in a state that the axis of the through-aperture 30 is aligned with that of the screw hole 32.

The pressure feeder 15 includes a tubular member 37 having a pressure feed passage 37A that is in communication with the through-hole 13A. The tubular member 37 includes connecting holes 37B on the upper surface side thereof. The connecting holes 37B are utilized to connect a lift including, e.g., a cylinder (not shown) to an upper opening. In addition, a side of the passage 37A has a hole, which is not shown, for discharging the material M to the outside such that a hose with a nozzle is designed to be connected to the hole.

Figure 5A:
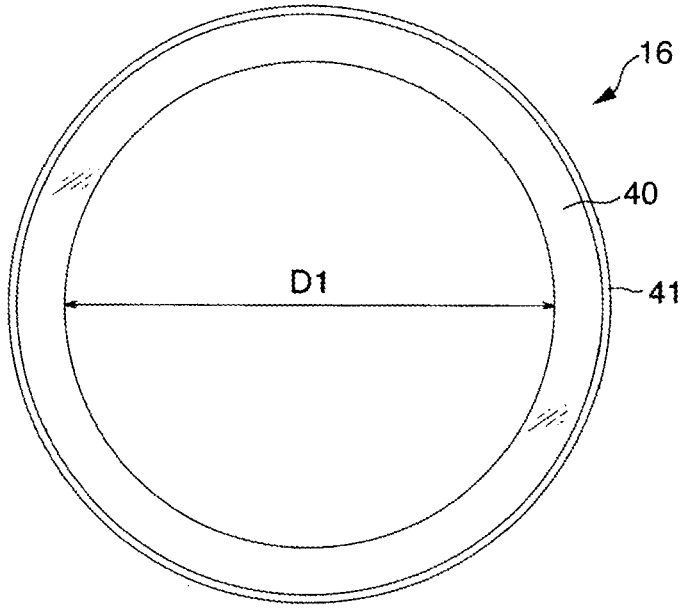
FIG. 5(A) is a schematic plan view of an annular member.
Figure 5B:
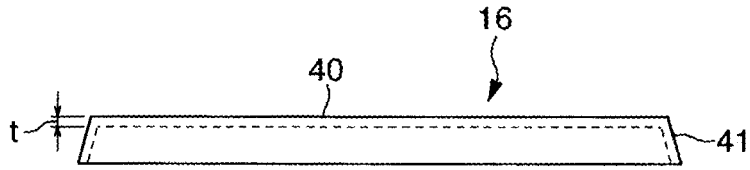
FIG. 5(B) is a front view thereof.
Figure 5C:
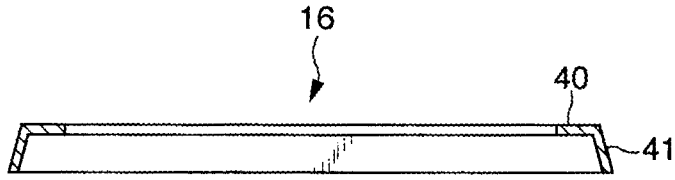
FIG. 5(C) is a cross-sectional view thereof.

The annular member 16 is composed of a piece molded integrally from a resin, and includes, as shown in FIG. 5, a plate-shaped ring portion 40, and a skirt-like outer peripheral portion 41 provided continuously downward from an outer periphery of the ring portion 40, and gradually increasing the diameter thereof as it goes downward to be capable of pressing the inner periphery of the container 12. The ring portion 40 has an inner diameter D1 of 200 mm and a thickness t of 5 mm. This enables the annular member 16 to relatively move in horizontal and vertical directions relative to the press member 13 when the ring portion 40 is positioned in the supporting space S. Note that FIG. 2 shows a state in which an upper edge on the upper surface side of the lower pressing plate 26 is in contact with a corner on the inner surface side of the ring portion 40 and the outer peripheral portion 41, and however, in fact, there is a clearance that can permit horizontal displacement of the ring portion 40.

Also, an outer diameter of the outer peripheral portion 41 is larger than an inner diameter of the container 12. By forcibly elastically deforming the outer peripheral portion 41 inward such that the outer peripheral portion 41 is fit within the container 12, the outer peripheral portion 41 is configured to be movable downward while pressing an inner periphery of the container 12 outward along a radial direction when the press member 13 is lowered.

Figure 6:
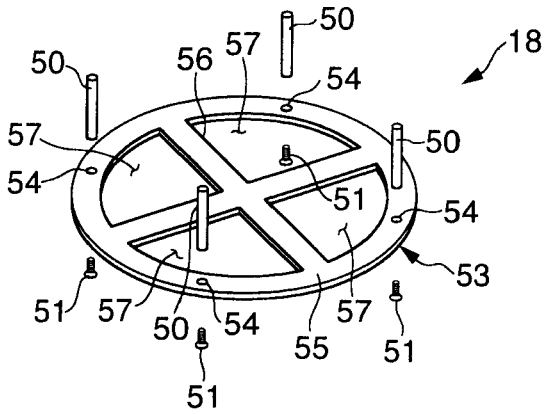
FIG. 6 is a perspective view of a bag suction preventing member.

The bag suction preventing member 18, as shown in FIGS. 2 and 6, includes spacers 50 of a plurality of columnar bodies which are secured, via means such as welding, on the planar portion 28 continued to the lower end of a taper hole 27 in the upper pressing plate 25; and a circular member 53 fixed at the lower ends of the spacers 50 using screws 51. Each spacer 50 has a screw hole (not shown) on the lower end side thereof, and the spacer 50 can be screwed by inserting a screw 51 through a hole 54 from below it formed on the outer peripheral side of the circular member 53.

The circular member 53 includes a closed-loop shaped circular frame 55, and cross frames 56 positioned on the inner peripheral side of the circular frame 55. Thus, a plurality of, e.g. four in the embodiment, substantially fan-shaped openings 57 in planar view are formed at intervals of 90 degrees in a circumferential direction. In the bag suction preventing member 18 being attached to the press member 13, the lower ends of the spacers 50 and the circular member 53 are configured to be protruded downward from a lower surface, or a pressing surface 26A, of the lower pressing plate 26. The amount of such a protrusion is substantially identical to the height of the circular recess 23 provided on the bottom wall portion 21 side of the container 12.

Figure 7:
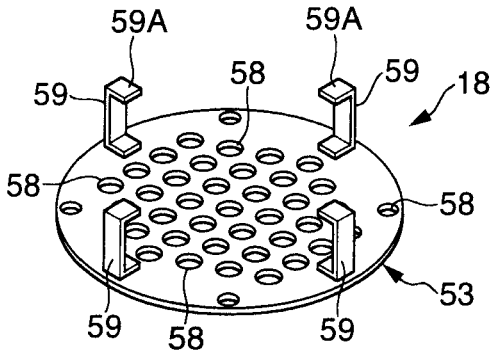
FIG. 7 is a perspective view of another bag suction preventing member.

The bag suction preventing member 18, as shown in FIG. 7, may have an arrangement in which a plurality of circular holes 58 are formed within a plane of the circular member 53. Preferably, the circular holes 58 are arranged more densely in a central region than the outer peripheral region. This is because, in the case of the material M having low viscosity, the material sucked into the press member 13 and the pressure feeder 15 can be easily dropped into the bag 11 when it is required to remove the press member 13 from the container 12 for cleaning before the material M in the bag 11 is used up.

It is noted that in fixing of the bag suction preventing member 18 shown in FIG. 7, spacers 59 each having a substantially U-like shape in side view is used to weld upper pieces 59A of the spacers 59 in FIG. 7 to the planar portion 28.

Then, suction and pressure feeding steps for the material M by the material pressure feeding apparatus 10 will be described, further with reference to FIG. 8.

First, for preparation for sucking and pressure-feeding of the material M, as shown in FIG. 2, a material M contained in a bag 11 is received into the container 12. In this case, the bag 11 is sealed on the opening side while the material M is contained, and received into the container 12 in an inverted position such that the sealed side is positioned on the bottom side of the container 12. The upper central region of the bag 11 is cut off along a substantially circular shape using a cutter blade to form the aperture 11A. The press member 13 and the pressure feeder 15 are placed onto the bag 11 while the bag suction preventing member 18 is arranged in the aperture 11A. Thus, the inside of the bag 11 is brought into communication with the through-hole 13A of the press member 13 and the pressure feed passage 37A.

Figure 8:
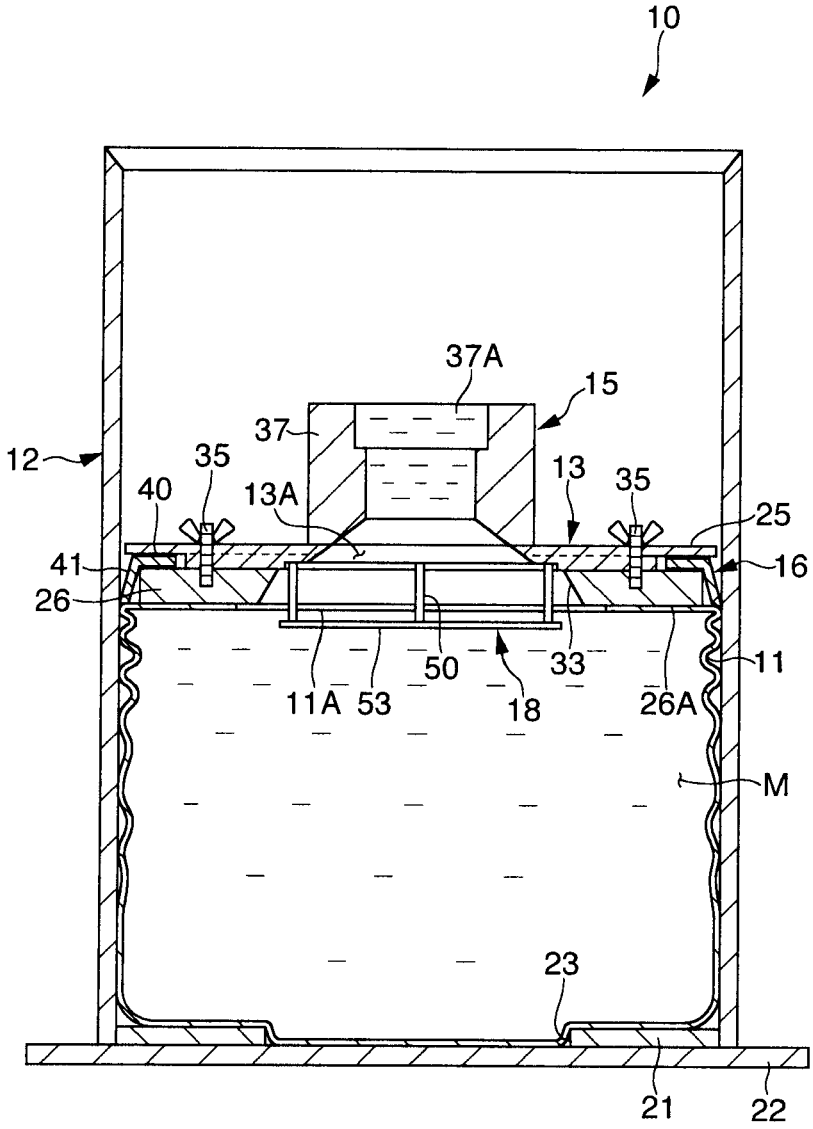
FIG. 8 is a vertical cross-sectional view showing a state in which a certain amount of a material has been discharged.

The lift (not shown) is driven to lower the press member 13 (see FIG. 8). This pressurizes the material in the bag 11, the material being sucked into the through-hole 13A and the pressure feed passage 37A, and discharged through a hose and a nozzle (not shown) connected to the pressure feed passage 37A.

In the case where the pressing surface 26A of the press member 13 is inclined relative to the horizon due to some factor, when the annular member 16 is supported by the press member 13 so as not to relatively move, the annular member 16 is also inclined. However, in the embodiment, the ring portion 40 of the annular member 16 is movably supported within the supporting space S of the press member 13, and moreover the annular member 16 is maintained in an initial horizontal position without any influence of the inclination of the press member 13 since the outer peripheral portion 41 of the annular member 16 exerts a pressing force on the inner periphery of the container 12 outward along a radial direction.

Therefore, this can prevent the bag 11 from being caught in a slight clearance that may occurs between the annular member 16 and the inner peripheral surface of the container 12 when the annular member 16 is inclined, and prevent failure due to the bag 11 being caught therein from occurring.

When the press member 13 exerts the pressing force on the material M, the upper portion side of the bag 11 is subjected to a drawing force into through-hole 13, and however the spacers 50 of the bag suction preventing member 18 act as a dam and restrict such drawing, and thus does not prevent the flow of the material in the through-hole 13A.

The material M can be consumed until the pressing surface 26A of the press member 13 reaches the limit of descent where it substantially brought into contact with the upper surface of the bottom wall portion 21 of the container 12. In this case, a protrusion portion of the bag suction preventing member 18 is received in the circular recess 23 although the bag suction preventing member 18 protrudes downward from the pressing surface 26A of the press member 13, and therefore this can reduce a waste of the material.

Note that, in this embodiment, the inclinations of the pressing means 13 and the pressure feeder 16 during pressure-feeding of the material were measured with a digital angle meter. This has demonstrated that it does not occur for the bag 11 to be caught in even when the inclination of about one degree occurs.

The best arrangement and so on for carrying out the present invention have been disclosed so far. However, the present invention is not limited to the above.

That is, the present invention has been specifically illustrated and described with respect to a particular embodiment. It is possible for a person skilled in the art to add various modifications to the above-described embodiment in shape, number and other detailed arrangements without departing from the scope of the technical spirit and the object of the present invention.

Therefore, the above-disclosed arrangement has been given only as an example for the purpose to facilitate understanding of the present invention, not to limit the present invention. Thus, the description using appellations of component members disregarding all or apart of the limitations such as the shape and the like are to be included within the present invention.

DESCRIPTION OF REFERENCE NUMERALS

10 Material pressure feeding apparatus
11 Bag
11A Aperture
12 Container
13 Press member
13A Through-hole
15 Pressure feeder
16 Annular member
18 Bag suction preventing member
25 Upper pressing plate
26 Lower pressing plate
37A Pressure feed passage
40 Ring portion
41 Outer peripheral portion
50 Spacer
53 Circular member
57 Opening
58 Circular hole
M Material
S Supporting space

The invention claimed is:

1. A material pressure feeding apparatus including a container having a top opening for receiving a bag, in which a viscous material is contained, a press member having a through-hole communicable with an aperture formed in an upper portion of the bag positioned within the container, the press member being positioned on the bag, and a pressure feeder including a pressure feed passage that is in communication with the through-hole, and feeding with pressure the material within the bag by lowering the press member, comprising:

an annular member positioned on the outer peripheral side of the press member to be capable to pressing an inner periphery of the container outward along a radial direction, wherein the annular member is supported by the press member while permitted to be relatively moved with respect to the press member, and the annular member is supported by the press member so as to be moveable in a horizontal and vertical direction, and wherein the press member comprises an upper pressing plate, and a lower pressing plate attached to a lower surface side of the upper pressing plate in a state of a supporting space is formed between a lower surface of the outer peripheral side of the upper pressing plate and the lower pressing plate, the annular member includes a plate-shaped ring portion, and an outer peripheral portion provided continuously downward from an outer periphery of the plate-shaped ring portion, the outer peripheral portion being capable of pressing the inner periphery of the container, and the plate-shaped ring portion is movable provided within the supporting space.

2. The material pressure feeding apparatus according to claim 1, further comprising a bag suction preventing member arranged in the through-hole of the press member, wherein the bag suction preventing member includes spacers arranged at predetermined intervals in a circumferential direction, and a circular member attached to the spacers.

3. The material pressure feeding apparatus according to claim 2, wherein the circular member comprises a plurality of openings at predetermined intervals in the circumferential direction, each of the plurality of openings being substantially fan-shaped in planar view.

4. The material pressure feeding apparatus according to claim 2, wherein the circular member comprises a plurality of circular holes, the plurality of circular holes arranged more densely in a central region than an outer peripheral region.

5. The material pressure feeding apparatus according to claim 1, wherein the press member comprises a ring-shaped upper pressing plate integrated with the pressure feeder such that the pressure feeder is positioned on an upper surface side thereof.

6. The material pressure feeding apparatus according to claim 1, wherein the annular member moves relatively in the horizontal and vertical directions relative to the press member when the ring portion is positioned in the supporting space.

* * * * *